US005588408A

United States Patent [19]

Kurihara

[11] Patent Number: 5,588,408

[45] Date of Patent: Dec. 31, 1996

[54] ENGINE UNIT

[75] Inventor: Katsumi Kurihara, Nagoya, Japan

[73] Assignee: Ryobi Limited, Tokyo, Japan

[21] Appl. No.: 576,299

[22] Filed: Dec. 21, 1995

[30] Foreign Application Priority Data

Dec. 22, 1994 [JP] Japan ..... 6-336145

[51] Int. Cl.[6] ..... F01M 9/06

[52] U.S. Cl. ..... 123/196 W; 184/6.18; 184/11.1

[58] Field of Search ..... 123/196 R, 196 W; 184/6.5, 6.8, 6.9, 6.18, 11.1

[56] References Cited

U.S. PATENT DOCUMENTS

| | | | |
|---|---|---|---|
| 5,090,375 | 2/1992 | Hudson | 123/196 W |
| 5,213,074 | 5/1993 | Imagawa et al. | 123/196 W |
| 5,447,127 | 9/1995 | Lück et al. | 123/196 W |

FOREIGN PATENT DOCUMENTS 618008 6/1994 Japan .

*Primary Examiner*—Erick R. Solis
*Attorney, Agent, or Firm*—Brooks & Kushman P.C.

[57] ABSTRACT

An engine unit in which a crank shaft is arranged perpendicularly in its housing in the state of use thereof comprises a housing defining a crank chamber therein, a crank shaft disposed in the crank chamber to be rotatable, a piston-cylinder assembly disposed in the housing, a valve mechanism operatively connected to the piston-cylinder assembly for sucking and discharging air in the cylinder, and a valve moving mechanism for driving the valve mechanism so as to open or close the same. The valve moving mechanism includes a push-rod members, a push-rod cover member covering the push-rod members with a space therebetween. A rocker chamber is disposed in the housing and communicated with the space, and a drain pipe is disposed between a lower portion of the rocker chamber and a lower portion of the crank chamber so as to establish communication therebetween with an inclination in the state of use. An agitation ring is mounted to the crank shaft so as to agitate and splash a lubrication oil in the crank chamber, and the housing is provided with a guide wall structure for guiding the splashed lubrication oil to the valve moving mechanism.

6 Claims, 5 Drawing Sheets

ENGINE UNIT

BACKGROUND OF THE INVENTION

The present invention relates to an engine unit provided with an oil lubrication system therefor of the type in which a crank shaft is arranged perpendicularly in a state of use, a lubrication oil agitation ring is mounted to the crank shaft of an engine, and when the crank shaft is rotated in a lubrication oil in a crank chamber of the engine, the lubrication oil is circulated in a lubrication circulation passage through a crank chamber wall, a valve moving mechanism, a rocker chamber, etc to the crank chamber.

Small machines such as lawn mower is usually equipped with small engine units each in which a crank shaft is arranged perpendicularly in the state of use and a lubrication system is also arranged for circulating a lubrication oil.

One example of a conventional lubrication system for an engine lubrication oil is disclosed in the Japanese Utility Model Publication No. HEI 6-18008, which is shown in FIGS. 4 and 5. Referring to these figures, a lubrication oil A in a crank chamber K is agitated by an oil splasher S driven by a crank shaft CR of an engine unit to thereby circulate the oil in the engine unit for the lubrication thereof. The oil A is delivered to a rocker chamber R through an upper oil supply passage P to supply the oil to various portions of the rocker chamber R and then return to the crank chamber K through a lower discharge passage Q. These passages P and Q are both opened to the crank chamber K and check valves V1 and V2 are incorporated to these passages P and Q, respectively.

A valve driving mechanism for driving a valve e through a cam a, a tappet b, a push-rod c, and a rocker arm d is disposed to a side portion of a cylinder. The cylinder is formed with a lubrication oil inlet/outlet port L at a level substantially the same height level of the cylinder, and the inlet/outlet port L is also opened to the crank chamber K to lubricate moving parts inside the cylinder.

Furthermore, the Japanese patent Laid-open Publication No. HEI 6-200776 of the same applicant of this application provides a valve moving mechanism for driving a valve, which is not disposed on the side portion of the cylinder and in which a single lubrication oil supply passage to a rocker chamber from a crank chamber is provided. This lubrication oil supply passage also serves as a lubrication oil discharge passage.

As described above, with respect to the oil lubrication systems of conventional engine units, one example shows the structure in which the lubrication oil supply passage from the crank chamber to the rocker chamber and the lubrication oil discharge passage are independently provided, and the other example shows the structure in which the single passage serving as the oil supply passage and oil discharge passage is provided.

In the former example, the check valves are arranged, which makes complicated the structure of the lubrication system, and moreover, in a case where the engine is inclined and the check valve is closed by the lubrication oil, it becomes impossible to guide the lubrication oil flow in one direction, resulting in that the lubrication oil remains excessively in the rocker chamber and the lubrication oil may flow into a combustion chamber, thus being troublesome, and in a case where the crank shaft is inclined, the lubrication oil flows in or out of the cylinder through the lubrication oil inlet/outlet port formed to the cylinder. In such cases, it becomes difficult to suitably maintain the lubricating condition of the lubrication oil.

On the other hand, in the latter example, the lubrication oil supply and discharge are performed through one passage, it is difficult to make balance the supply and discharge of the oil, and in a case where the engine is driven in an inclined state and the opening of the passage to the crank chamber is closed, it becomes impossible to discharge the lubrication oil from the rocker chamber and the oil remains excessively therein and, in an adverse case, the lubrication oil may flows in the combustion chamber through a valve guide, thus providing a problem.

SUMMARY OF THE INVENTION

An object of the present invention is to substantially eliminate defects or drawbacks encountered in the prior art and to provide an improved engine unit capable of smoothly circulating a lubrication oil in the engine unit to lubricate various parts of the engine unit.

This and other objects can be achieved according to the present invention by providing an engine unit comprising:

- a housing defining a crank chamber and a cam chamber which is communicated with said crank chamber therein;
- a crank shaft disposed in the crank chamber to be rotatable so as to extend in a perpendicular direction in a state of use;
- a piston-cylinder assembly mounted to the housing and including a cylinder and a piston operatively connected to the crank shaft;
- a valve mechanism operatively connected to the piston-cylinder assembly for sucking and discharging air in the cylinder;
- a valve moving mechanism for driving the valve mechanism so as to open or close the same, said valve moving mechanism including a push-rod means;
- a push-rod cover covering the push-rod means with a space therebetween;
- a rocker chamber connected to the push-rod cover so as to communicate with said space;
- a drain passage disposed between the rocker chamber and the crank chamber so as to establish communication therebetween with an inclination in the state of use;
- an agitation means mounted to the crank shaft so as to agitate and splash a lubrication oil in the crank chamber; and
- a guide means provided for the housing for guiding the splashed lubrication oil to the valve moving mechanism.

In preferred embodiments, the valve mechanism comprises a suction valve and a discharge valve and the valve moving mechanism comprises a suction side cam follower, a discharge side cam follower, a first push-rod operatively connected to the suction side cam follower and a second push-rod operatively connected to the discharge side cam follower, the suction side and discharge side cam followers abutting against an outer surface of a cam mounted to a cam shaft disposed in the housing.

The drain passage comprises a drain pipe having one end opened to the rocker chamber and another end opened to the crank chamber. The another end of the drain pipe is opened at a portion of a level below a surface level of the lubrication oil in the crank chamber in the state of use. The drain pipe is disposed in the state of use with an inclination with respect to an axial direction of the cylinder.

The guide means is composed of a curved wall section constituting the housing.

According to the structure of the present invention described above, in the state of usual operation of the engine unit, the central axis of the crank shaft extends perpendicular direction, and when the engine is driven, the lubrication oil in the crank chamber is agitation and splashed by the agitation ring mounted to the lower end portion of the crank shaft. The splashed lubrication oil is guided along the curved wall section of the housing as the guide means to the rocker chamber through the space formed between the push-rod cover and the push-rods. The oil is then circulated to lubricate the various parts of the cylinder head and returns to the crank chamber through the inclined drain pipe connecting the rocker chamber and the crank chamber.

Accordingly, the lubrication oil supply mechanism and discharge mechanism are independently arranged to balance the supply and discharge thereof and the counter-flow of the lubrication oil can be thus prevented.

The nature and further features of the present invention will be made more clear from the following descriptions made with reference to the accompanying drawings.

BRIEF DESCRIPTION OF THE DRAWINGS

In the accompanying drawings:

FIG. 3 is an illustration of a valve moving mechanism of the engine unit of FIG. 1 or 2, in which

DESCRIPTION OF THE PREFERRED EMBODIMENT

One preferred embodiment of the present invention will be described hereunder with reference to FIGS. 1 to 3.

Figure 1:
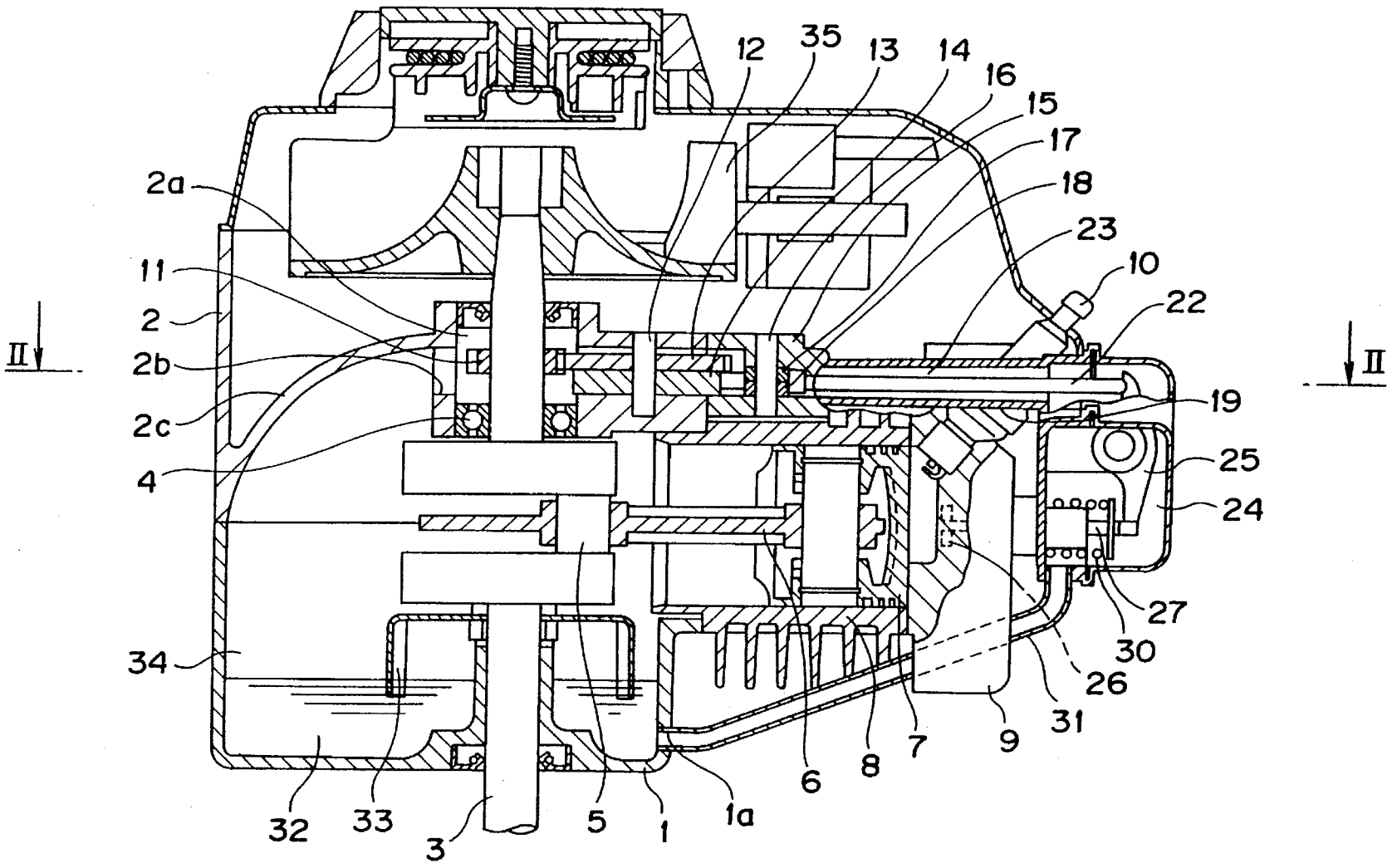
FIG. 1 is a elevational section of an engine unit according to one embodiment of the present invention in a state of use.
Figure 2:
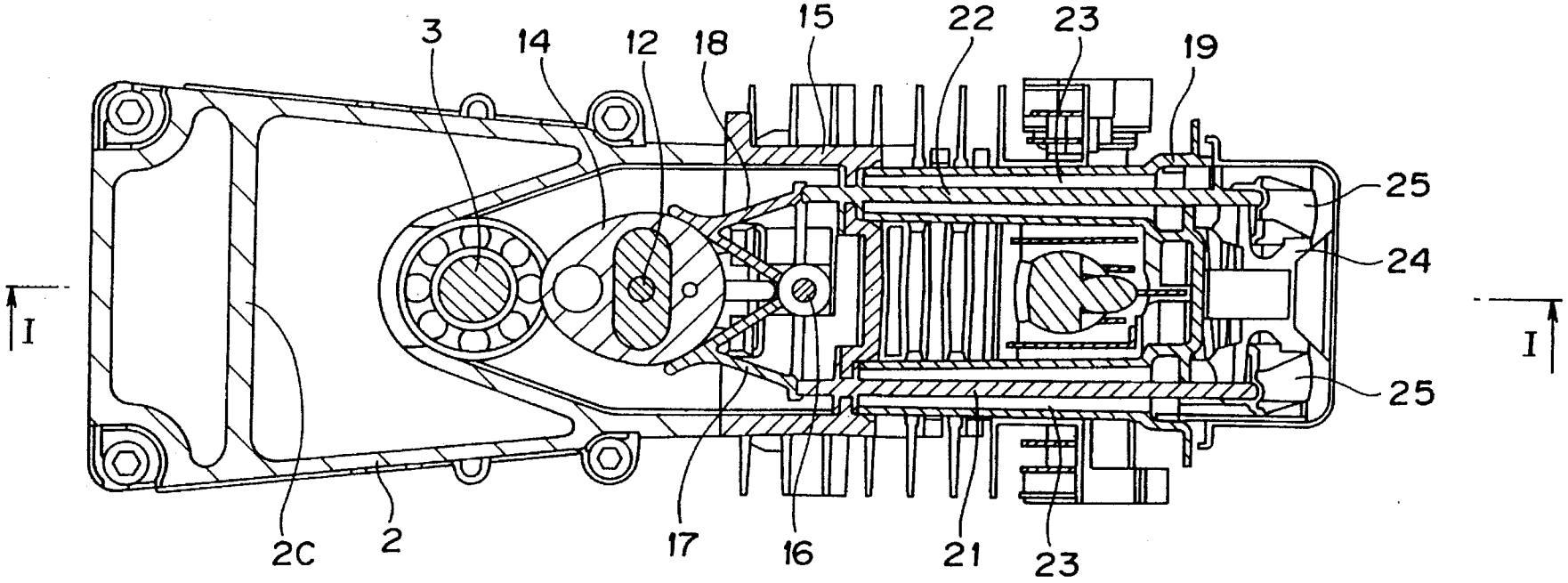
FIG. 2 is a longitudinal section of the engine unit of FIG. 1.

FIG. 1 is an elevational section taken along the line I—I in FIG. 2, and shows an engine unit according to one embodiment of the present invention, showing a state in which the engine unit is positioned in a using state. The engine unit is provided with a housing having a lower housing member 1 and an upper housing member 2 disposed above the lower housing 1. A crank shaft 3 is disposed in the housing to be rotatable through a bearing 4, and the crank shaft is operatively connected to a connecting rod 6 through a crank pin 5 provided for the crank shaft 3. In the state of use of the engine unit, the crank shaft 3 is arranged perpendicular in the housing and, in this meaning, the engine unit of the invention may be called as a vertical shaft-type engine.

A piston-cylinder assembly is also mounted to the housing, which is composed of a piston 7 connected to a front end of the connecting rod 6 and a cylinder 8 into which the piston 7 is reciprocally movable. A cylinder head 9 is mounted to the front end of the cylinder 8 and an ignition plug 10 is provided for this cylinder head 9.

A crank gear 11 is mounted to the crank shaft 3. A camshaft 12 is mounted to the upper housing member 2 and a cam gear 13 is mounted to the camshaft 12 to be rotatable in engagement with crank gear 11. A cam 14 is also mounted to the camshaft 12 to be rotatable together with the cam gear 13.

A casing 15 is also disposed on the upper housing 2 at a right side portion therein as viewed in FIG. 1, and a shaft 16 is mounted to the casing 15. As shown in FIG. 2, which is a longitudinal section taken along the line II—II in FIG. 1, a discharge side cam follower 17 and a suction side cam follower 18 are mounted to the shaft 16 so as to abut against the cam surface of the cam 14. In the right hand portion of the casing 15, a push-rod cover 19 is provided, in which a push-rod 21 connected to the discharge side cam follower 17 and a push-rod 22 connected to the suction side cam follower 18 are disposed with space 23. A rocker chamber 24 is connected to the right side, as viewed in FIG. 2, of the push-rod cover 19, and rocker arms 25, 25 are disposed to be swingable inside the rocker chamber 24.

Figure 3A:
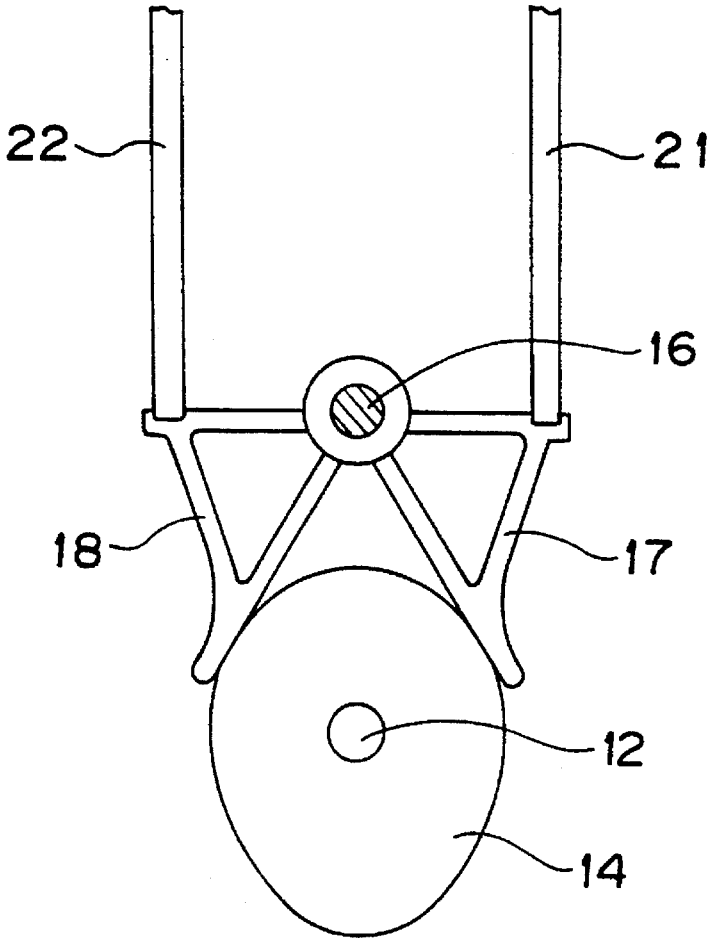
FIG. 3A is a plan view thereof and FIG. 3B is a side view of FIG. 3A.
Figure 3B:
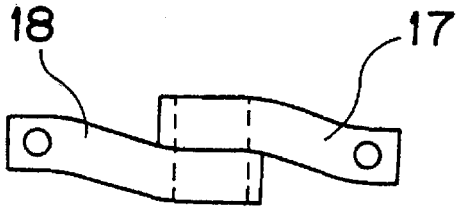
Figure 4:
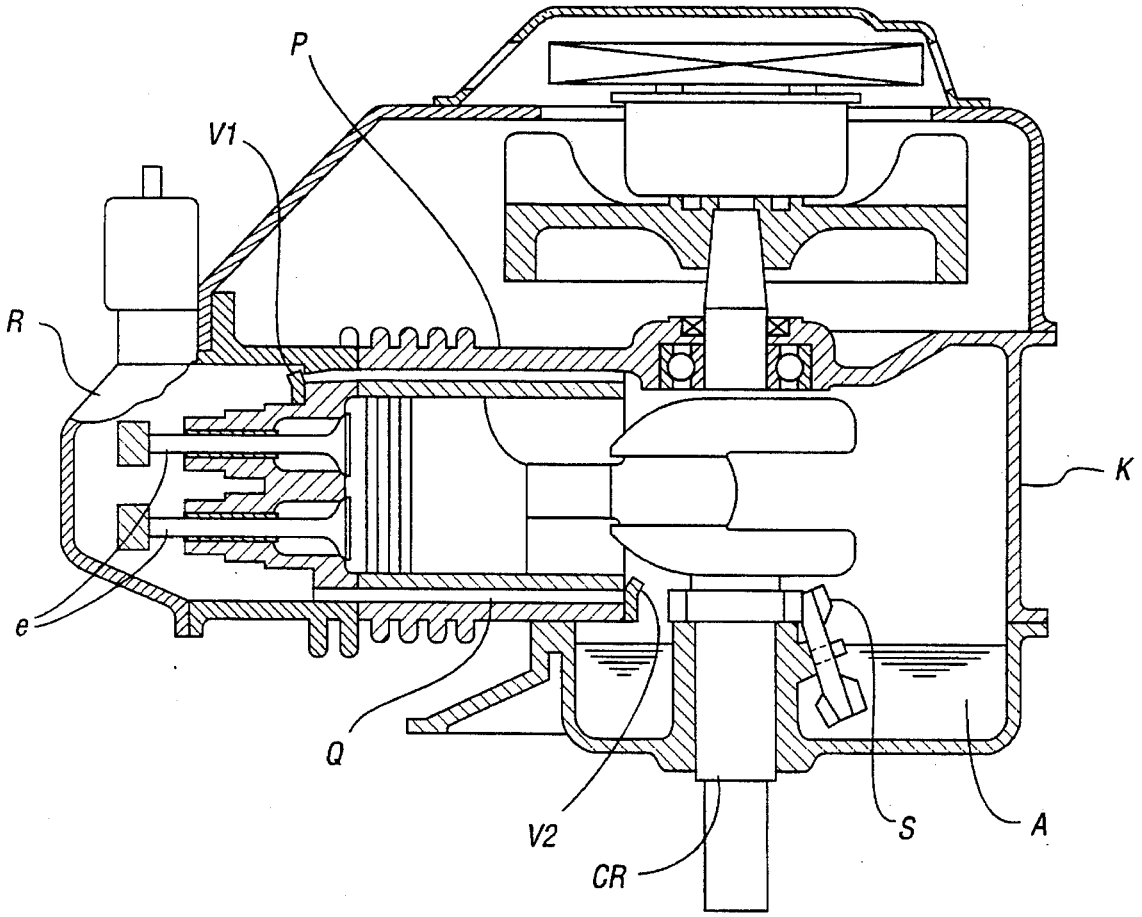
Fig. 4 (PRIOR ART)
FIG. 4 is an elevational section of an engine unit provided with a lubrication oil circulation system of a conventional structure.
Figure 5A:
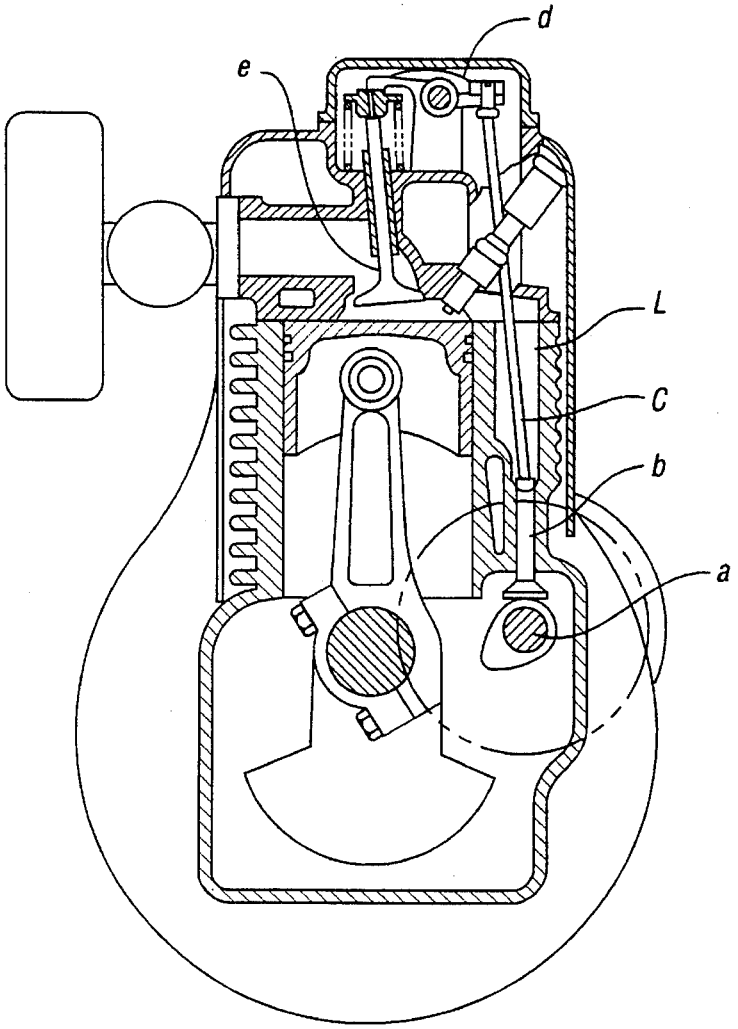
Fig. 5A (PRIOR ART)
FIG. 5A is a sectional view of an engine unit of another example of a conventional structure and FIG. 5B is a plane view thereof.
Figure 5B:
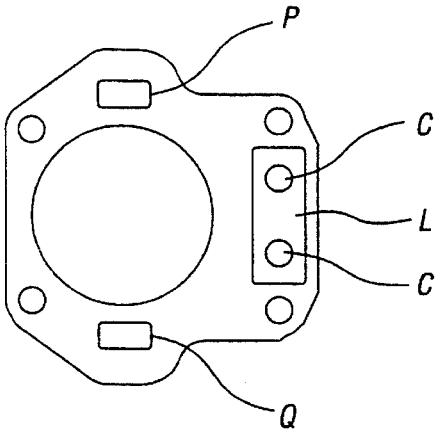
Fig. 5B (PRIOR ART)

Referring to FIG. 3, one of the rocker arms 25, 25 has one end to which the front end of the push-rod 21 is mounted and the other one of the rocker arms 25, 25 has one end to which the front end of the push-rod 22 is also mounted. As shown in FIG. 1, the one of the rocker arms 25, 25 has the other one end to which a rod 27 integrally formed with a discharge valve 26 is mounted, and the other rocker arms 25, 25 has the other one end to which a rod, not shown, integrally formed with a suction valve, not shown, is mounted. A spring 30 is fitted to the outer periphery of the rod 27. Further, though not shown, the discharge side has a structure substantially identical to that of the suction side.

The lower housing member 1 has a lower side surface to which is formed an opening 1*a*, which is communicated with the lower surface of the rocker chamber 24 through a drain pipe 31 in a manner inclined to the axial direction of the cylinder 8. The opening 1*a* is usually formed at a portion of a level lower than a surface level of a lubrication oil 32 in the crank chamber 34 in the state of use of the crank shaft 3 as shown in FIG. 1. An agitation ring 33 is mounted to the crank shaft at a portion near the lubrication oil 32 to agitate and splash the lubrication oil.

The upper housing member 2 has a cam chamber 2*a* for supporting the crank shaft 3, and an opening 2*b* communicating the cam chamber 2*a* with the crank chamber 34 is formed to a wall section defining the cam chamber 2*a*. The upper housing member 2 is also provided with a wall section 2*c* having a curved surface suitable for smoothly guiding the lubrication oil 32 splashed by the agitation ring 33 to the opening 2*b*. A cooling fan 35 is attached to the front end portion of the crank shaft 3 to forcibly cool the engine.

The engine unit of the present invention of the structure described above will operate as follows.

When the engine starts to drive and the crank shaft 3 is rotated in the state such as shown in FIG. 1, the crank gear 11 mounted to the crank shaft 3 is also rotated. The rotation of the crank gear 11 is transmitted to the cam gear 13 and the cam 14 engaged with the cam gear 13 is hence rotated. As shown in FIG. 2, when the cam 14 is rotated, the push-rod 21 and the push-rod 22 are moved with predetermined timings so as to open or close the discharge valve 26 and the suction valve by way of the motions of the rocker arms 25 and the rod 27 in the arrangement of FIG. 1. According to the open/close timings of the discharge valve 26 and the suction valve, the ignition plug 10 is ignited and a combustion action starts in the cylinder 8 to thereby move the piston 7 and the connecting rod 6 through which the crank shaft 3 is rotated.

The rotation of the crank shaft 3 operates the agitation ring 33 by which the lubrication oil 32 in the crank chamber 34 is agitated and splashed, and the agitated and splashed lubrication oil 32 enters the cam chamber 2*a* through the curved surface of the wall section 2*c* of the upper housing member 2 and the opening 2*b*. The lubrication oil 32 serves at this time to lubricate the portion between the crankshaft 3 and the bearing 4, and the lubrication oil 32 entering the cam chamber 2*a* serves to lubricate the cam shaft 12, the cam gear 13, the cam 14, the shaft 16, the discharge side cam follower 17, the suction side cam follower 18 and etc. The lubrication oil 32 increased in lubrication speed by the operation of the cam 14 is further moved rightward as viewed in FIG. 1 and enters the space 23 in the push-rod cover 19. The lubrication oil 32 is then moved rightward in the space 23 and enters the rocker chamber 24 in which the lubrication oil 32 lubricates the rocker arms 25, the rod 27, etc. disposed therein. The lubrication oil 32 then returns to the crank chamber 34 through the drain pipe 31, thus completing the circulation of the lubrication oil 32.

Thus, the lubrication oil can be smoothly circulated in the engine unit while lubricating the various parts constituting the engine unit.

What is claimed is:

1. An engine unit comprising:

a housing defining a crank chamber and a cam chamber which is communicated with said crank chamber therein;

a crank shaft disposed in the crank chamber to be rotatable so as to extend in a perpendicular direction in a state of use;

a piston-cylinder assembly mounted to the housing and including a cylinder and a piston operatively connected to the crank shaft;

a valve mechanism operatively connected to the piston-cylinder assembly for sucking and discharging air in the cylinder;

a valve moving mechanism for driving the valve mechanism so as to open or close the same, said valve moving mechanism including a push-rod means;

a push-rod cover member covering the push-rod means with a space therebetween;

a rocker chamber connected to the push-rod cover so as to communicate with said space;

a drain passage means disposed between said rocker chamber and said crank chamber so as to establish communication therebetween with an inclination in the state of use;

an agitation means mounted to said crank shaft so as to agitate and splash a lubrication oil in the crank chamber; and a guide means provided for the housing for guiding the splashed lubrication oil to said valve moving mechanism.

2. An engine unit according to claim 1, wherein said valve mechanism comprising a suction valve and a discharge valve and said valve moving mechanism comprising a suction side cam follower, a discharge side cam follower, a first push-rod operatively connected to the suction side cam follower and a second push-rod operatively connected to the discharge side cam follower, said suction side and discharge side cam followers abutting against an outer surface of a cam mounted to a cam shaft disposed in the housing.

3. An engine unit according to claim 1, wherein said drain passage means comprises a drain pipe having one end opened to the rocker chamber and another end opened to the crank chamber.

4. An engine unit according to claim 3, wherein said another end of the drain pipe is at a portion of a level below a surface level of the lubrication oil in the crank chamber in the state of use.

5. An engine unit according to claim 4, wherein said drain pipe is disposed in the state of use with an inclination with respect to an axial direction of the cylinder.

6. An engine unit according to claim 1, wherein said guide means is composed of a curved wall section constituting the housing.

* * * * *